United States Patent [19]

Junker

[11] 4,123,963

[45] Nov. 7, 1978

[54] FIREARM AND CASELESS AMMUNITION THEREFOR

[76] Inventor: Ralph D. Junker, 33 N. Main St., Southampton, N.Y. 11968

[21] Appl. No.: 796,005

[22] Filed: May 11, 1977

[51] Int. Cl.[2] ..... F41D 1/04

[52] U.S. Cl. ..... 89/152; 42/16; 42/25; 89/14 C; 89/33 C; 89/179; 89/188; 102/38 CC

[58] Field of Search ..... 42/2, 15, 16, 25, 39.5; 89/152, 153, 179, 188

[56] References Cited

U.S. PATENT DOCUMENTS

| | | | |
|---|---|---|---|
| 30,760 | 11/1860 | Reeder | 42/15 |
| 941,662 | 11/1909 | Smith | 42/15 |
| 3,474,560 | 10/1969 | Ramsay | 42/15 |
| 3,722,123 | 3/1973 | Parisi | 42/16 |

*Primary Examiner*—Stephen C. Bentley

*Attorney, Agent, or Firm*—Burns, Doane, Swecker & Mathis

[57] ABSTRACT

A firearm for firing caseless ammunition includes a barrel, a receiver, a bolt, and a firing pin. The bolt includes laterally open pockets for receiving a projectile and a separate propellant cartridge. The bolt carries an extractor to extract unspent projectiles. The bolt drives a locking collar to lock itself in forward position. The locking collar is unlocked by the recoil-action of the firing pin. The firing pin is driven by a spring biased hammer; the firing pin then drives the hammer by recoil action, causing the hammer to unlock the locking collar. A gas seal for the firing pin includes a deformable ring which is deformed by ignition gas pressure into sealing engagement with the firing pin. An anti-recoil muzzle at the discharge end of the barrel has a reaction surface thereof cleaned of combustion deposits by a plurality of bristles extending from the barrel. A propellant cartridge comprises a plurality of telescoping nitrocellulose jackets which form a propellant chamber and a primer compartment.

18 Claims, 20 Drawing Figures

10
14
16
18
20
22
26
28
30
32
38
42
43
46
48
50
56
58
60
61
62
64
66
68
70
72
74
76
80
82
89
92
96
106
108
110
113
120
156
158
160
162
164
166
168
170
172
174
230
232
238
240
242

FIREARM AND CASELESS AMMUNITION THEREFOR

BACKGROUND AND OBJECTS

The invention relates to improvements in firearms employing consumable, caseless ammunition.

In the military, there is an interest in a form of ammunition for rifles and machine guns which does not require a metal case to house propellant. While there are a number of reasons for this interest, one compelling reason centers on the fact that the metal case comprises nearly 50% of the weight of each cartridge. Thus, for ammunition of like weight, a successful "caseless" format would afford a 2:1 firepower advantage over conventional weapons.

Previous proposals in the caseless field are exemplified in U.S. Pat. No. 3,474,560 issued to Ramsay on Oct. 28, 1969; No. 3,483,793 issued to Ramsay on Dec. 16, 1969; No. 3,641,692 issued to Wells on Feb. 15, 1972; Nos. 3,641,867, 3,828,676, and 3,990,347 issued Feb. 15, 1972, Aug. 13, 1974, and Nov. 9, 1976, respectively, to the present inventor, and No. 3,772,123 issued to Parisi on Mar. 27, 1973. The disclosures in U.S. Pat. Nos. 3,641,867, and 3,828,676, and 3,990,347 of this inventor are incorporated by reference herein as if set forth at length.

Some prior proposals center around the employment, in conventional firearms, of a cartridge which is physically similar to the metal cartridge in that both the projectile and caseless propellant are packaged or fixed together. During loading, the cartridge would be engaged by a bolt and rammed forwardly into the firing position. In such an instance, the cartridge propellant must be exceedingly strong to withstand the forces encountered since the bolt, especially in the typical reciprocating-action automatic firearm, drives the cartridge against fixed chamber shoulders with considerable closing velocity. It has not proven feasible, however, to achieve the required degree of cartridge strength without interlacing the propellant with foreign materials which, upon firing, leave unacceptable high amounts of residue.

Some proposals in the caseless field fail to provide for convenient extraction of an unspent projectile. That is, in the event of a misfire, substantial efforts and disassembly of the firearm may be necessary to remove the projectile and/or cartridge.

Other problems in the caseless area involve complicated mechanisms for unlocking the bolt for recoil and recocking motion. It would be desirable to provide a simplified unlocking system.

Although it has been heretofore proposed to harness the recoil motion of the firing pin to unlock the bolt, such proposals involve complex systems which do not enable the firing sequence to be initiated with the bolt in a forward, locked position. It would be desirable to avoid this problem as well as to provide a system where a spring activates the firing pin without being subjected to excessive stressing by firing pin recoil.

It has been previously proposed to obturate around a firing pin in a manner requiring the formation of grooves in the pin to receive sealing rings. This, however, weakens the firing pin.

Previous firearm designs render impracticable the use of replacement bolts. It would be desirable if bolts which have become fouled could be replaced conveniently in the field.

Proposals have been made for providing anti-recoil muzzles at the discharge end of a barrel. The muzzle is to be provided with a reaction surface to be acted upon by ignition gases. However, the reaction surface may have a tendency to accumulate carbon deposits. Moreover, the surface of the barrel opposite the reaction surface is acted upon by the ignition gases to create recoil forces which, in effect, cancel-out the effectiveness of the anti-recoil muzzle.

It is, therefore, an object of the present invention to eliminate problems such as these without unduly complicating firearm operation.

It is a further object of the present invention to enable caseless ammunition to be effectively and efficiently employed in firearms.

It is another object of the invention to minimize the shock to which caseless propellant is subjected in a firearm, while providing for the extraction of unspent propellant and projectile.

It is another object of the invention to provide a bolt locking mechanism of such simplicity that it is practical to manufacture interchangeable or reserve bolts.

Another objective is to provide a bolt which is removable for cleaning and maintenance purposes.

It is a further object of the invention to provide a novel bolt locking mechanism in which the bolt locks itself and is unlocked by the recoil action of a firing pin.

It is another object of the invention to provide a novel firearm in which the firing pin is urged by spring power to a firing position, and the firing pin is subjected to recoil action to unlock the bolt without imposing undue stress upon the spring.

It is an additional object of the invention to provide novel means for obturating around a firing pin without requiring the placement of grooves in the firing pin.

It is another object of the invention to provide an effective anti-recoil muzzle and means for resisting carbon build-ups on the reaction surface.

It is still a further object of the invention to provide a novel propellant cartridge which is inexpensive to manufacture, leaves virtually no residue, and is easily handled within the firearm.

BRIEF SUMMARY OF PREFERRED EMBODIMENTS

These and other objects are achieved by the present invention in which a bolt is slidably mounted in a receiver and includes laterally open pockets which receive a projectile and a separate propellant cartridge from a magazine. An extractor is carried by the bolt to extract an unspent projectile.

The extractor comprises a pin having a leg which contacts a wall of the receiver, and an integral extractor lip. When the bolt is retracted, contact between the leg and receiver wall causes the extractor lip to be rotated into engagement with a groove in the projectile.

A bolt locking collar is provided which is mounted for rotatable, non-reciprocable movement. The bolt extends through the collar and is non-rotatable. Bolt locking lugs enter slots in the collar during advancement of the bolt and contact the collar in a manner rotating the collar to a position in which the locking lugs are retained within an offset locking portion of the slots.

The collar is unlocked by the action of a firing pin which recoils in response to the firing of a shot. The firing pin engages a rotatable hammer which, in turn, contacts and rotates the collar. The collar is removable to facilitate servicing.

The hammer is spring biased to a position in which it propels the firing pin in a firing direction. The relationship between the hammer and spring is such that the spring stores energy during only a portion of the rotary travel of the hammer.

An obturation seal is mounted on the bolt in surrounding relation to the firing pin. The seal includes a deformable ring sandwiched between rigid rings. One of the rigid rings is exposed to ignition gas pressure to deform the deformable ring against the firing pin to effect a gas seal.

The firearm includes a barrel which has an anti-recoil muzzle secured at a discharge end thereof. The barrel carries stiff bristles which scrub combustion deposits from a reaction surface of the muzzle.

A propellant cartridge for use with a separate projectile includes a pair of open ended cylindrical jackets which are telescoped together to form a propellant-carrying chamber. An additional jacket is telescoped over the closed end of one of the other jackets to form a primer-carrying compartment.

THE DRAWINGS

These and other advantages of the present invention will become apparent from the following detailed description of preferred embodiments thereof wherein like numerals designate like elements and in which.

Figures 1, 17:
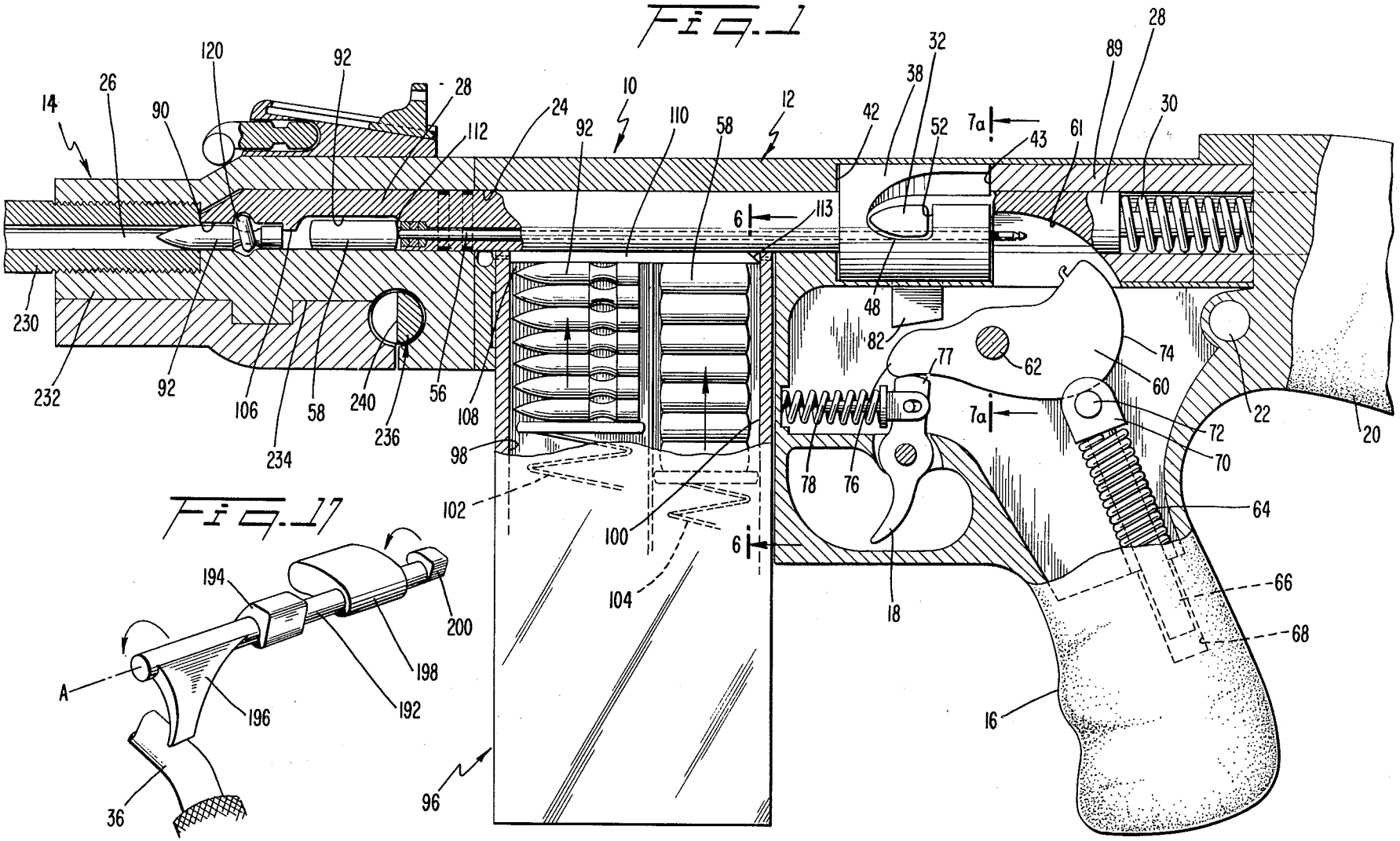
FIG. 1 is a side elevational view of a firearm according to the present invention, with a portion thereof broken away to depict internal parts thereof in a ready-for-firing position.
Figures 2, 5, 14:
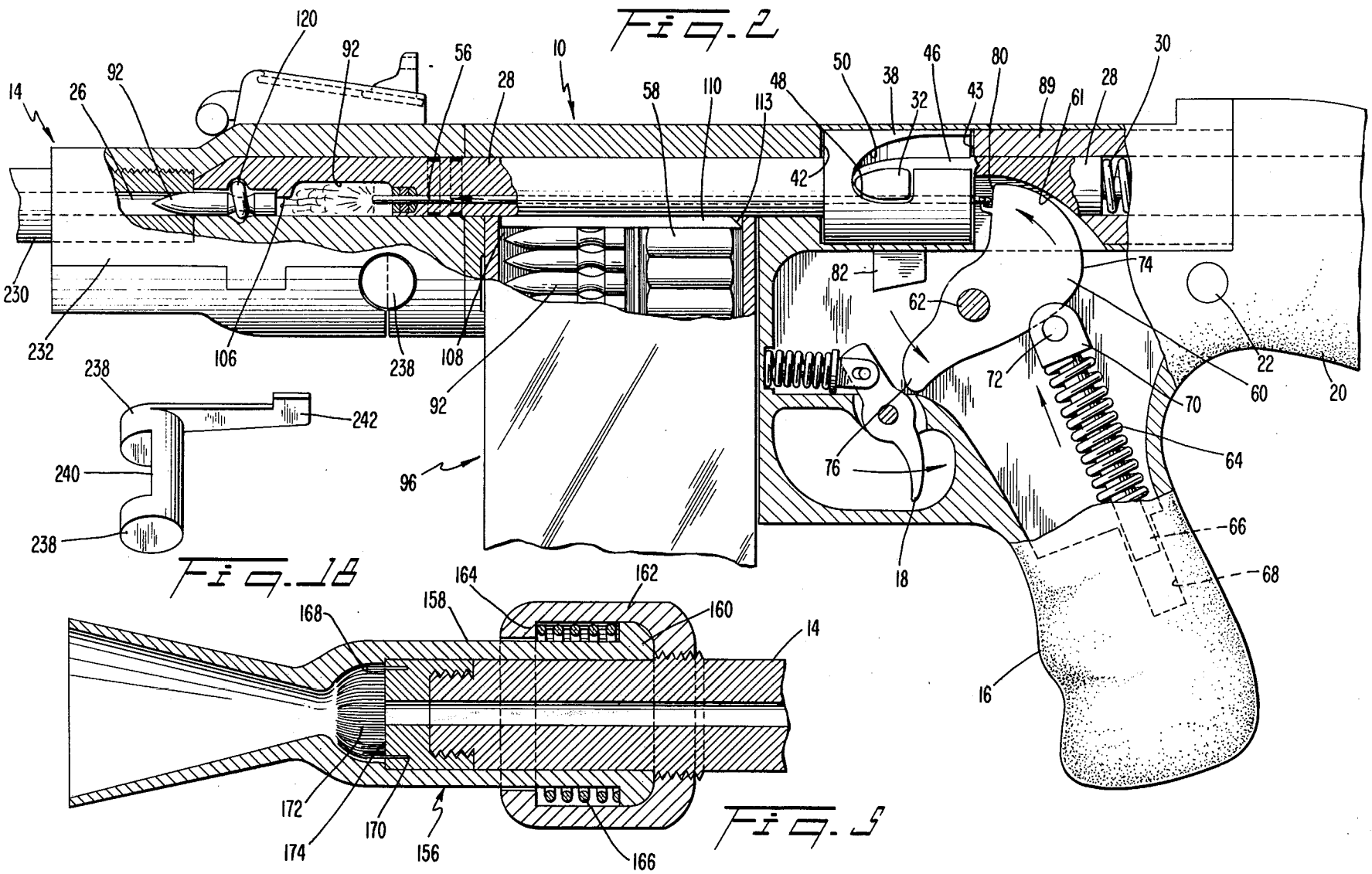
FIG. 2 is a view similar to FIG. 1 in which detonation has occurred.
FIG. 5 is a longitudinal cross-sectional view of the front end of the firearm barrel depicting an anti-recoil feature of the invention.
Figure 8:
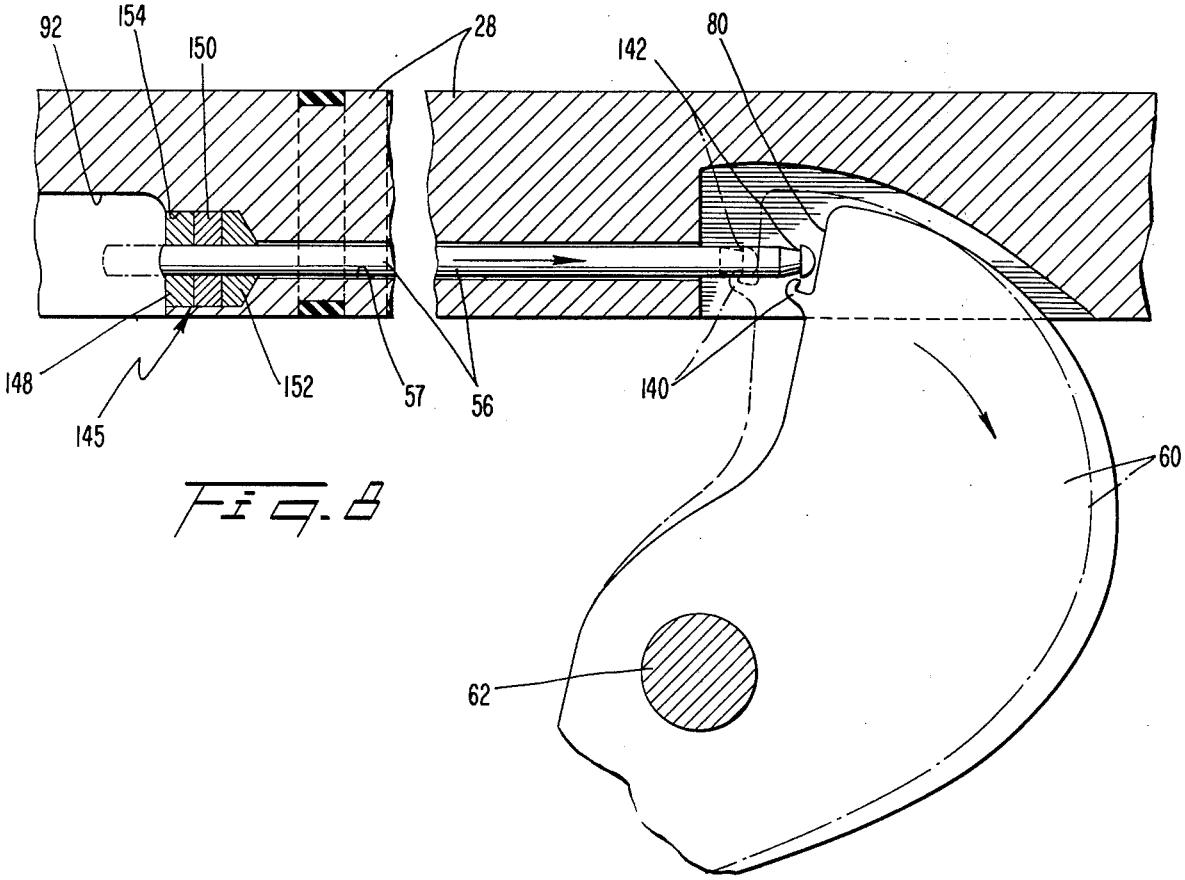
Figure 9:
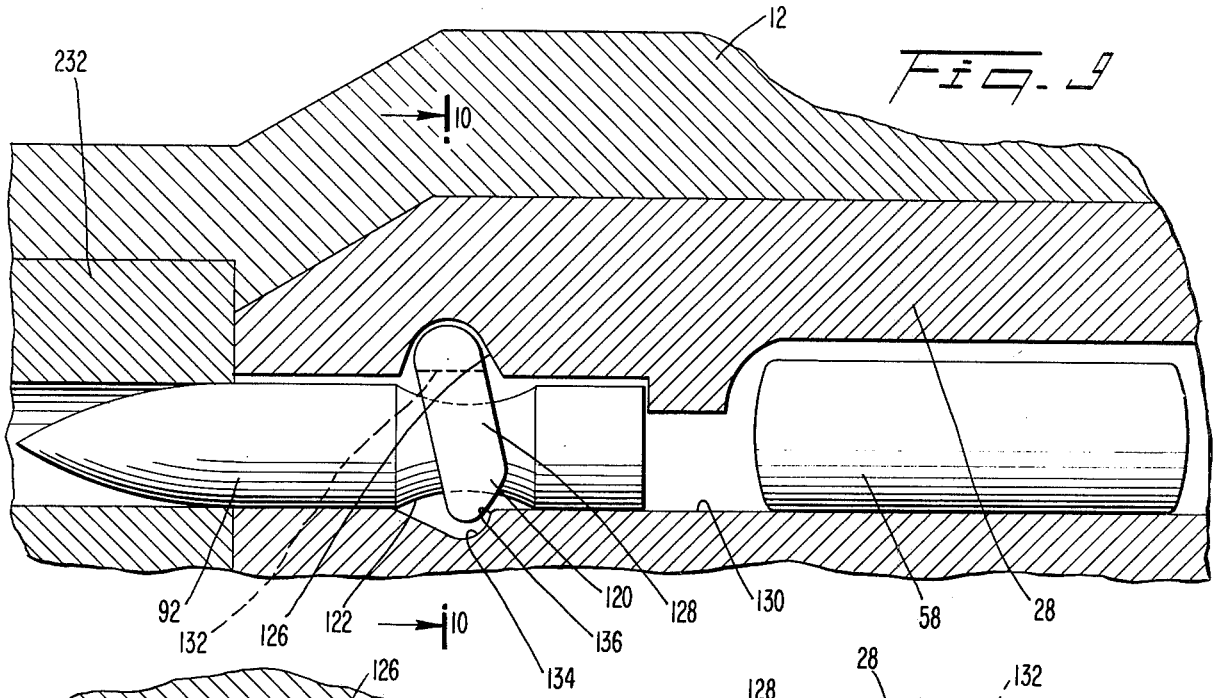
Figure 10:
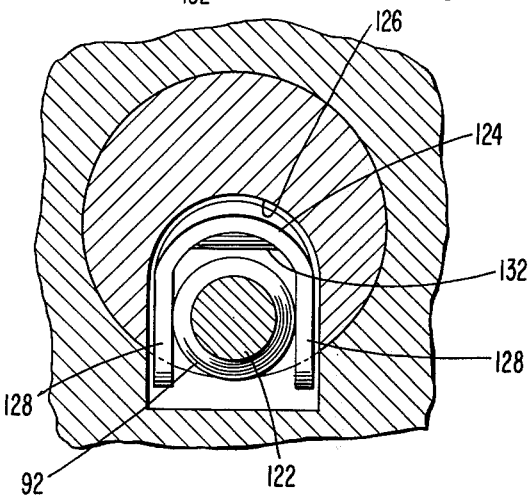
Figure 11:
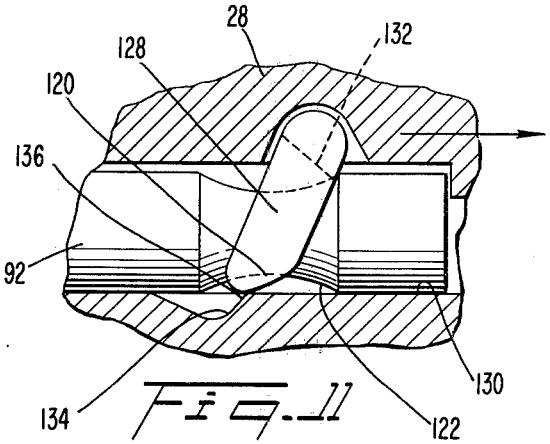
Figure 12:
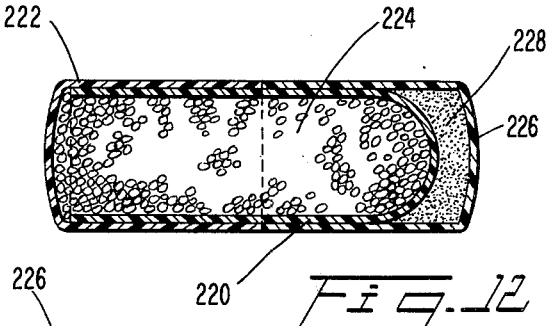
Figure 13:
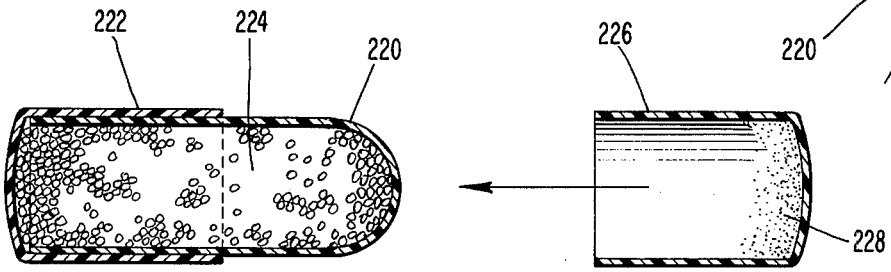
Figures 14, 15, 16:
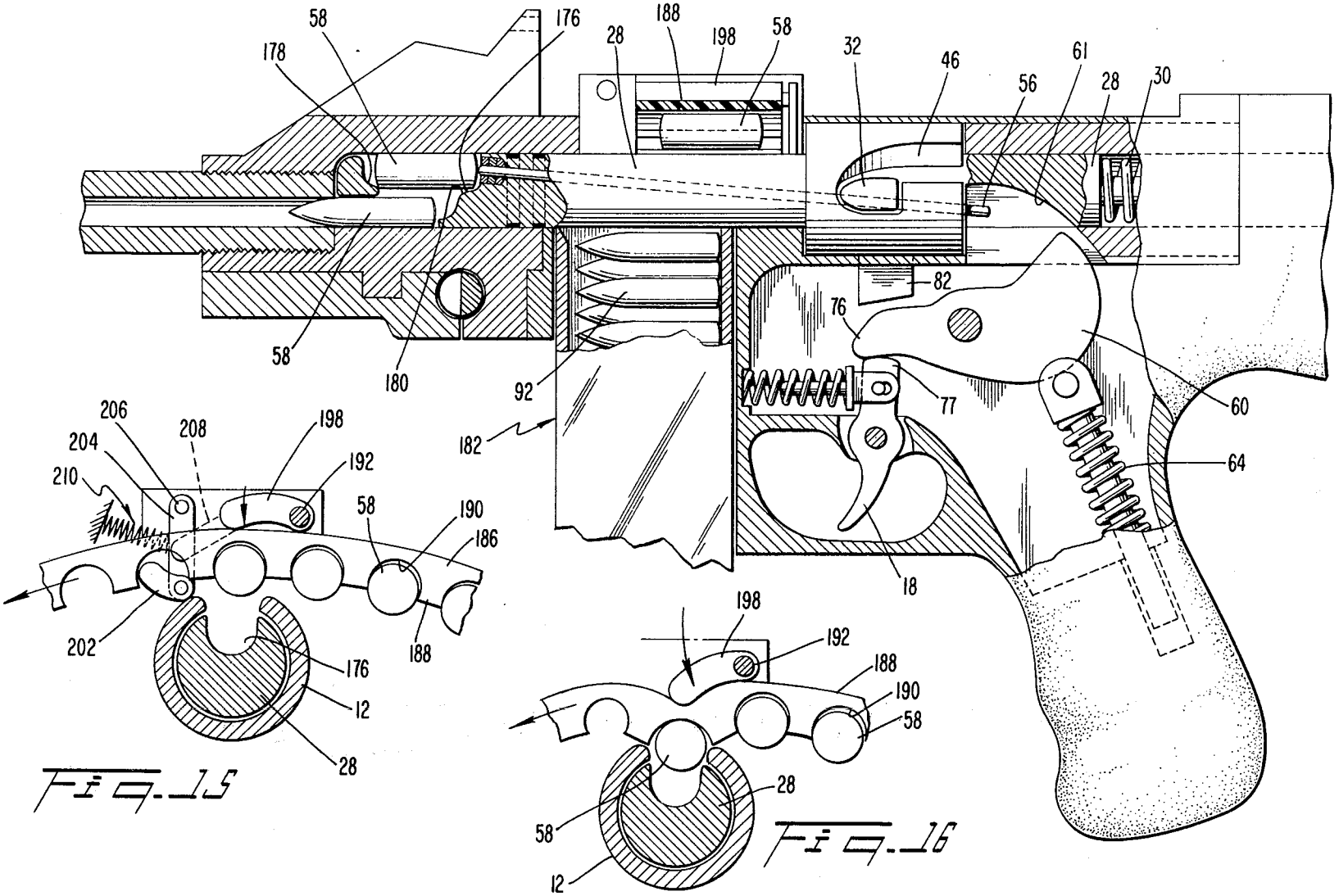

FIG. *7a* is a cross-sectional view taken along line *7a—7a* in FIG. 1 depicting the bolt locked within the locking collar;

FIG. *7b* is a view similar to FIG. *7a* after the locking collar has been partially rotated to an unlocking position;

FIG. *7c* is a view similar to FIG. *7a* after the locking collar has been fully rotated to its unlocking position;

FIG. 8 is an enlarged, fragmentary view of the bolt, firing pin, and hammer portions of the firearm after the hammer has retracted the firearm during a manual rearming step;

FIG. 9 is an enlarged, fragmentary view of the front end of the bolt, depicting a projectile ejector mechanism of the present invention disposed in a non-functional position;

FIG. 10 is a cross-sectional view taken along line 10—10 of FIG. 9;

FIG. 11 is a view similar to FIG. 9 depicting the ejector in a functional position for ejection of a projectile;

FIG. 12 is a cross-sectional view of a propellant cartridge according to the present invention;

FIG. 13 is an exploded view of the cartridge depicted in FIG. 12;

FIG. 14 is a longitudinal sectional view with parts broken away of another firearm embodiment according to the present invention, depicting the firearm in a ready-to-fire condition;

FIG. 15 is an enlarged view of a propellant cartridge feeding mechanism of the firearm of FIG. 14;

FIG. 16 is a view similar to FIG. 15 depicting the ejection of a propellant cartridge into the bolt;

FIG. 17 is an isometric view of a drive system for the feeding mechanism; and FIG. 18 is an isometric view of a barrel-securing latch.

DETAILED DESCRIPTION OF PREFERRED EMBODIMENTS

One preferred form of firearm according to the present invention is illustrated in FIGS. 1–13. This firearm 10 is of the single shot repeater type and includes a receiver 12 and a barrel 14 attached to the forward end of the receiver. The receiver 12 includes a hand grip 16 and a trigger 18. A stock 20 is detachably secured to the receiver by a bolt 22. The receiver contains a bore 24 which communicates with a bore 26 of the barrel.

Firing Mechanism

A bolt 28 is reciprocably mounted in the bore 24 of the receiver 12. The bolt 28 is urged to a forward, obturating position by means of a coil compression spring 30.

Figure 7A:
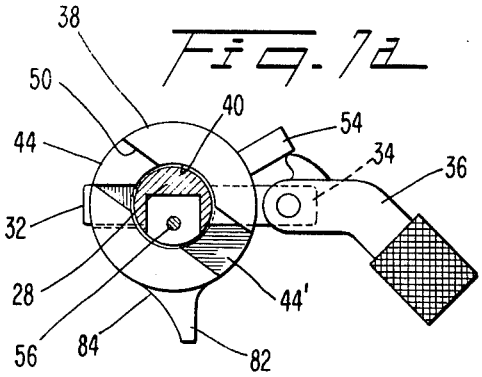
Figure 7B:
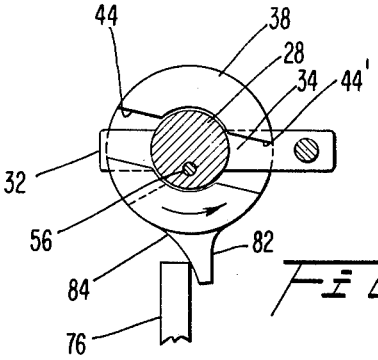
Figure 7C:
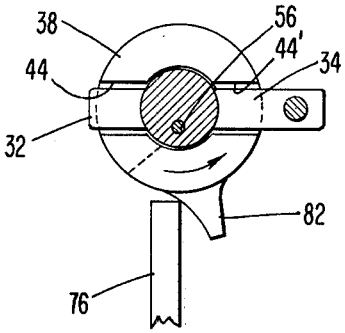

Affixed rigidly to the bolt and extending radially therefrom in diagonally opposite directions are two locking lugs 32, 34, one 34 of which includes a cocking handle 36 (FIG. 7). The cocking handle 36 projects through a longitudinally extending slot (not shown) in the receiver and the outer end of the locking lug 32 rides in a receiver groove (not shown), to prevent rotation of the bolt 28 relative to the receiver, thereby restricting the bolt of longitudinal reciprocation.

The bolt is encompassed at a rearward end thereof by a cylindrical locking collar 38. This locking collar 38 includes a central bore 40 through which the bolt extends for relative reciprocal movement. The locking collar 38 is mounted for rotational movement within the receiver and relative to the bolt and is restrained against longitudinal movement by suitable means, such as by appropriately positioned shoulders 42, 43.

The locking collar includes a pair of slots 44, 44'. Each slot comprises a rearwardly open, longitudinally extending portion 46 and a circumferentially extending portion 48 (FIG. 4), the latter being offset from the longitudinal portion and defining a locking recess. Each slot includes a wall 50 which, at its forward end, extends inwardly and helically. This wall 50 is oriented to be contacted by the associated locking lug 32 or 34, during forward travel of the latter within the slot 44 o4 44', to produce rotation of the locking collar 38. That is, as the locking lug travels forwardly within the slot, under the urging of the bolt spring 30, and approaches the forward end thereof, it contacts the wall 50 and rotationally cams of the locking collar during the last stage of bolt forward travel. Accordingly, the locking recesses 48 are rotated into a position where stop surface 52 thereof become disposed across the rear end of each locking lug 32, 34. In this manner, rearward travel of the bolt 28 within the receiver is prevented.

If, for reasons to be discussed, it is desired to retract the bolt in the absence of firing a shot, the locking collar can be manually rotated by means of an unlocking lug 54 (FIG. 7) which extends through a circumferential slot (not shown) in the receiver so as to be externally accessible. This allows the locking collar 38 to be suitably positioned for retraction of the bolt 28 by the cocking handle 36.

A firing pin 56 is reciprocably mounted within a through-passage 157 (FIG. 8) in the bolt 28 and has a forward end adapted to produce ignition of a propellant charge 58 during forward travel of the pin. Forward travel of the firing pin is produced by a hammer 60. The hammer 60 is rotatably mounted within the receiver and within a recess 61 in the bolt by a pivot pin 62. Acting against a rear edge of the hammer is a hammer spring 64. The hammer spring 64 comprises a coil compression spring which encompasses a slidable rod 66. The rod 66 is confined to reciprocable motion within a guide passage 68. At its upper end the rod carries a head comprising a U-shaped bracket 70 having a pin 72 extending between the legs of the U-bracket. A curved edge 74 of the hammer is received between the legs of the U-bracket and is engaged by the pin 72. In this fashion, the hammer is constantly biased toward a firing position (i.e., counterclockwise as viewed in FIG. 1) by the spring 64 which exerts its biasing force in a linear direction.

The hammer 60 also includes a control extension 76 which overlies a sear portion 77 of the trigger 18 when the latter is in a rest or non-firing position (FIG. 1). A sear spring 78 biases the trigger to such rest position. When the hammer extension 76 overlies the sear, rotation of the hammer by the hammer spring is prevented. Upon actuation of the trigger to a firing position (FIG. 2), the sear is displaced from engagement with the hammer extension, allowing the hammer spring 64 to swing the hammer 60 to a firing position, whereupon an abutment face 80 of the hammer strikes the firing pin 56 and rams it forwardly to detonate a propellant charge, in a manner to be discussed.

When detonation occurs, recoil of the bolt 28 by ignition gas pressure is prevented by the stop surface 52 of the locking collar. The firing pin, however, is responsive to such gas pressure and is rammed rearwardly into contact with the hammer and swings the hammer counter to the bias of the hammer spring 64 (i.e., the hammer is urged clockwise as viewed in FIG. 3). The action of the firing pin against the hammer is sufficient to swing the hammer past its initial rest position (after camming the trigger aside if necessary) to an override position (FIG. 4), whereupon it acts upon the locking collar.

In this connection, the locking collar 38 includes a downwardly projecting turn lug 82 which functions as a cam follower when the hammer is in its override position. That is, either the hammer or the turn lug, but preferably the hammer, includes a cam surface 84 which displaces the turn lug circumferentially as the hammer contacts the turn lug in approaching the end of its override position. This causes the slots 44, 44' of the locking collar to be rotated to positions wherein the locking lugs 32, 34 of the bolt 28 become aligned with the longitudinal portions 46 of the slots. This enables the bolt 28 to be displaced rearwardly by residual ignition gas pressure.

Due to the curved nature of the edge 74 of the hammer 60, the hammer spring 64 is not compressed by an amount proportional to the entire rotational distance of travel of the hammer. That is, the hammer spring is compressed in response to an initial segment of travel of the hammer from the firing position, to about the position shown in FIG. 3. Thereafter, the pin 72 contacts a generally circular segment 86 of the hammer 60, whose geometrical center is defined by the hammer pivot 62. Consequently, little additional compression of the spring 64 is produced. As a result, travel of the hammer 60 to its override position (FIG. 4) is facilitated, and the spring is not subjected to excessive stressing.

It will be realized that upon reaching the end of its override position, the hammer 60 is returned by the hammer spring 64 to the rest position, whereupon it rests upon the sear 77 (assuming that the trigger has been released).

The locking collar 38 is manually removable from the receiver 12. In this connection, an axially removable retainer sleeve 89, which defines the shoulder 43, can be disposed between the locking collar and the stock 20. By removing the stock, the retainer sleeve 89, and the bolt 28, the locking collar can be removed for servicing or replacement.

Loading Mechanism

The projectile-handling portion of the firearm will now be discussed with particular reference to FIGS. 1–4, 6, and 9–11.

At its forward end the bolt 28 includes a pair of longitudinally spaced, laterally open pockets 90, 92 for the reception of a projectile 92 and the propellant cartridge 58, respectively. The projectile and cartridge are housed within a magazine 96 which is carried by the receiver 12 and which feeds laterally into the receiver bore 24. The magazine 96 includes dual compartments 98, 100 for storing projectiles and propellant cartridges, respectively. Both compartments include a feed spring 102, 104 which urges the projectiles 92 and cartridges 58 toward the receiver bore 24.

A preferred form of propellant cartridge 58 will be discussed subsequently in detail. Suffice it to say, at this point however, that such a cartridge comprises an outer flexible cover which houses a propellant charge and a primer, the latter being ignitable in response to the compressive action of the firing pin 56. One acceptable form of cartridge answering this description is set forth in this inventor's U.S. Pat. No. 3,828,676 issued Aug. 13, 1974.

The pockets 90, 92 are separated by a divider lip 106 which engages the rear of the projectile to advance the latter. This lip 106 extends only partially across the juncture of the pockets so that the pockets are in continuous communication with one another.

Mounted on the magazine 96 in overlying relation to a feed opening 108 of the magazine is a trip plate 110. This plate 110 is pivotably mounted at one side (FIG. 6) and is rotatable between a closed position (solid line position of FIG. 6) in which the feed opening 108 is blocked, and an open position in which the feed opening is unblocked (broken line position of FIG. 6). When the bolt 28 is retracted, i.e., shifted rearwardly to a loading position (FIG. 1), the projectile and cartridge components force the trip plate 110 open under the urging of the magazine springs 102, 104 and enter their respective pockets 90, 92.

When the bolt 28 is advanced, a forwardly facing shoulder 112 of the cartridge pocket engages the back of the cartridge, and a forwardly facing wall of the divider lip 106 engages the back end of the projectile 92 to advance the projectile and cartridge. When the bolt 28 has been fully advanced so that the bolt locking lugs 32, 34 are received in the locking recesses 48 of the locking collar 38, the projectile will project slightly into the barrel bore 26 (FIG. 1). The barrel bore 26 and projectile 92 are dimensioned to provide a snug fit therebetween for effecting suitable obturation.

The end 112 of the cartridge pocket includes, at one side, a projection (not shown) which engages an inclined face 113 of the trip plate to cam the trip plate downwardly as the bolt is advanced.

It will be realized that when the projectile and cartridge are disposed in the firing or armed position (FIG. 1), detonation of the propellant charge by the firing pin produces high-pressure ignition gases which communicate with the rear of the projectile to expel the latter through the barrel. The cartridge materials are fully combustible so that the pockets are emptied, with no appreciable residue remaining.

Projectile Extractor

In the event that a misfire should occur, or it is desired for certain reasons to disarm the firearm subsequent to being placed in an armed condition, it is necessary that the projectile and cartridge be extracted. This is achieved by an extractor 120 depicted mainly in FIGS. 9–11.

The extractor 120 comprises an inverted U-shaped pin which cooperates with an annular groove 122 in the projectile 92. This extractor pin 120 has a bight portion 124 which is received within a recess 126 adjacent the front end of the bolt 28. Legs 128 of the extractor pin extend downwardly from the bight portion in straddling relationship to the projectile 92. These legs 128 are arranged to contact and ride upon the bottom surface 130 of the receiver bore 24 and, in so doing, control the orientation of the bight portion. That is, the bight portion has an extractor lip 132 extending across the underside thereof. When the bolt is displaced forwardly, the legs are disposed in a lightly rearwardly swept orientation (FIG. 1) and the extractor lip 132 is located above the projectile, i.e., the lip 132 is situated laterally of the projectile groove 132. When the bolt reaches the armed position, the bottom ends of the legs enter a notch 134 within the receiver bore 24. In the event that a shot is not fired and extraction of the projectile 92 and/or cartridge 58 is required, the bolt 28 is manually retracted by the cocking handle 36. In so doing, the bottom ends of the legs of the extractor pin contact the rear edges 136 of the notches, causing the extractor pin 120 to swivel about the bight portion. Consequently, the extractor lip 132 enters the annular groove 122 of the projectile and pushes the projectile rearwardly through the receiver bore as the bolt is retracted. During this travel, the legs of the extractor pin will be disposed in a slightly forward swept orientation relative to the bight portion (FIG. 11).

To accommodate rejection of the projectile 92 and cartridge 58, the magazine 96 is removed from the receiver 12, thereby allowing the projectile and cartridge to fall through the opening previously occupied by the magazine.

Firing Pin Retractor

In the event that a misfire has occurred, it will also be necessary to retract the firing pin 56. This is accomplished by means of the hammer 60 which carries a resiliently flexible hook 140. This hook engages a notch 142 at the rear end of the firing pin as the hammer drives the firing pin forward (FIG. 8).

Rotation of the hammer in the opposite direction retracts the firing pin. When the firing pin reaches a proper rearward position, the hook will be released from the firing pin due to the change in inclination of the hook caused by the curved path about the pivot axis 62 about which the hook travels.

Obturation of Firing Pin

A gas seal assembly 145 is provided to seal around the periphery of the firing pin 56 when a round has been fired (FIG. 8). This seal assembly 145 comprises a plurality of individual rings 148, 150, 152 which are inserted into a forwardly open annular compartment 154 in the bolt 28. The compartment is concentric with the firing pin passage 57. The three rings 148, 150, 152 include inner and outer rings 148, 152 formed of spring steel, and an intermediate ring 150 formed of a softer metal such as brass which can be compressed or deformed. The outer ring 148 is subjected to the pressure of ignition gases and functions to forcefully sandwich the intermediate ring 150 between itself and the inner ring 152 in a manner causing the intermediate ring to deform and tighten against the outer periphery of the firing pin 56. This action produces a sealing effect to resist rearward escape of gas and gas pressure through the firing pin passage 57. Contact of the intermediate ring 150 with the firing pin is not sufficient to unduly retard recoil of the firing pin by ignition gas pressure.

Anti-Recoil Muzzle

In order to counteract to some degree the recoil effects of detonation, a longitudinally displaceable muzzle 156 is mounted on the front end of the barrel. The muzzle includes a sleeve 158 which encompasses the front end of the barrel and is slidable longitudinally relative thereto. This sleeve 158 includes an annular leg 160 which is slidable within a collar 162 that is fixed to the barrel. The collar has a radially inwardly extending shoulder 164 which retains the leg 160. A coil compression spring 166 is disposed within the collar 162 and acts between the shoulder 164 and the leg 160 to bias the sleeve rearwardly. The muzzle includes a reaction surface 168 which is spaced longitudinally from the end of the barrel and upon which the ignition gases act to urge the sleeve forwardly in response to firing a round. Resulting forward travel of the muzzle is transmitted to the barrel by the spring 166 and the collar 162 to aid somewhat in counteracting the recoil effects.

Mounted on the front end of the barrel is a threaded barrel extension, or false muzzle 170, which carries an annular array of spring steel bristles 172. These bristles, which can be on the order of 1 or 2 mm. in diameter, for example, project forwardly to form a steel brush which is engageable with the reaction surface 168. The reaction surface is preferably of a tapering nature, and the bristles become of progressively longer length in a radially inward direction. That is, the bristles nearer the axis of the barrel are longer than those further away from such axis. The bristles 172 are of sufficient length to assure that as the sleeve is spring-urged rearwardly to a rest position, the tips of the bristles engage and scrape the reaction surface to resist the build-up of carbon or other deposits on the reaction surface.

Significantly, the presence of the bristles reduces the effective area of the front surface 174 of the barrel extension. That is, there is less area of this surface against which ignition gases can act to counteract the anti-recoil action of the muzzle, since the area occupied by the bristles cannot be acted upon to produce recoil. Nor can the tips of the bristles be acted upon to produce recoil since the bristles are not sufficiently rigid to transmit axial forces to any appreciable degree.

Modified Bolt

A modified form of the bolt is depicted in FIGS. 14-17. In this embodiment, a cartridge pocket 176 is situated above the projectile pocket in piggy-back fashion. The cartridge pocket 176 is formed by front and rear ledges 178, 180 on the bolt so that the pockets are maintained in communication with one another via the space between the ledges. One effect of such a piggy-back or superimposed arrangement is a shortening of the effective stroke of the bolt, thereby shortening the overall cycle time. This is especially useful in machine guns since the rate of fire can be increased.

A magazine 182 carries projectiles 92 which are fed into the projectile pocket as previously described. Feeding of the cartridge pocket takes place from above by means of a belt feed system 184. This belt feed system 184 comprises a drum magazine (not shown) which houses a coiled belt 186 formed of plastic. The belt 186 includes a plurality of resilient fingers 188 forming recesses 190 that carry cylindrical propellant cartridges 58.

In order to both feed the bolt and inject cartridges, a mechanism is provided which includes a rod 192 which is mounted to the receiver housing via a bearing block 194 for rotation about an axis A that is parallel to the barrel axis (FIG. 17). The rod carries a downwardly extending cam follower 196 which cooperates with the cocking handle 36 to produce rotation of the rod. Since the cocking handle is driven rearwardly with the bolt following the firing of a round, it will cam the cam follower and produce rotation of the rod. Mounted on the rod are a pair of drive cams 198, 200. A first of the drive cams 198 is situated above the belt 186 and is capable of pushing a cartridge 58 from the belt into the cartridge pocket 176 when the rod 192 is rotated (FIG. 16). At the same time, the second control cam 200 actuates a belt feed pawl 202 to advance the belt 186. The pawl is rotatably mounted at the end of an arm 204, the latter being pivotably mounted at 206 for rotation about an axis extending parallel to the axis of the barrel. The arm carries a finger 208 which extends toward the second control cam 200 so that when the second control cam rotates, it pivots the arm and pawl. The pawl is positionable within an emptied recess 190 and acts upon the wall thereof to advance the belt. A suitable spring 210 is provided to return the arm and cam 198 to their original position following a feeding step. The pawl is spring biased via a torsion spring (not shown) toward its position within a recess shown in FIG. 15 and is rotatable from that position, relative to the arm (i.e., rotatable counterclockwise as viewed in FIG. 15), so that the pawl can pass beneath a finger 188 and enter the next emptied recess 190 when the arm is returned to its FIG. 15 rest position.

In this embodiment the firing pin is inclined upwardly from rear to front to contact the cartridge.

Propellant Cartridge

The preferred propellant cartridge 58 is generally cylindrical in configuration and carries a charge of propellant material and a primer compound (FIGS. 12-13). The cartridge includes first and second jackets 220, 222 which are of cylindrical shape, each having open and closed ends. The first jacket 220 is smaller in diameter than the second jacket 222, enabling the open end of the first jacket 220 to be telescopingly received within the open end of the second jacket 222. This arrangement defines a chamber 224 which is occupied by the propellant charge, such as gunpowder.

A third cylindrical jacket 226 is provided, having open and closed ends and being of substantially the same diameter as the second jacket 222. The closed end of the first jacket 220 is telescopingly received in the open end of the third jacket 226, with the open ends of the second and third jackets 222, 226 disposed in abutting relation. The third jacket 226 is of a length suitable for defining, together with the closed end of the first jacket 220, a compartment 228 which is occupied by a compression-ignitable priming compound.

The cartridge 58 is inserted within the bolt 28 such that the primer-containing end thereof faces the firing pin 56. When the firing pin is actuated, it strikes the closed end of the third jacket 226 with great force, to compress the primer compound against the closed end of the first jacket 220, the latter functioning as an anvil. In response to this compression, the primer detonates and ignites the propellant charge.

The jackets 220, 222, 226 are formed of a tough film of unpasticized high nitrogen nitrocellulose which exhibits a high tolerance to heat and low moisture permeability. This film burns at rates commensurate with conventional gunpowder without leaving an appreciable residue. The second and third jackets 222, 226 are suitably fused together or adhered by a nitrocellulose compound. Reference may be had to the inventor's U.S. Pat. No. 3,828,678 for further details concerning available residue-free materials for the cartridge.

Barrel Mounting

The barrel 14 is mounted by means of a quick release arrangement for exposing the interior of the firearm for cleaning and maintenance. The barrel includes a main part 230 and a screwed-on extension 232. The barrel extension 232 fits into recesses 234 in the receiver and is secured therein by a rotatable latch 236 (FIG. 18). The latch includes bearing portions 238 which are rotatably mounted in the receiver, and a bridge part 240 therebetween which, when the latch is rotated via a handle 242 to a locking position, blocks removal of the barrel. When the latch is rotated to an unlocking position, the bridge 240 is displaced so as to permit removal of the barrel. Accordingly, by retracting the bolt 28 clear of the barrel extension 232, and unlocking the latch 240, the barrel 14 can be removed to permit servicing of the firearm parts of substitution of a cold barrel.

OPERATION

In operation of the embodiment disclosed in conjunction with FIGS. 1-13, the magazine 96 is loaded with projectiles 92 and cartridges 58 and is installed within the receiver 12. An initial charge is fed into the bolt by manually retracting the bolt 28 by the cocking handle 36. This done following manual rotation of the locking collar 38 by the manual lug 54 to align the locking lugs 32, 34 of the bolt with the longitudinal parts 46 of the slots 44, 44'.

When the pockets 90, 92 of the retracted bolt 28 arrive at a location above the magazine feed opening 108, the uppermost projectile 92 and cartridge 58, under the urging of the magazine springs 102, 104 enter the respective pockets. Retraction of the bolt also causes the rear end of the bolt to engage the impact face 80 of the hammer 60 and rotate the hammer to a cocked posture against the bias of the hammer spring 64. Since the hammer 60 is momentarily connected to the firing pin 56 by the retractor hook 140, the firing pin is retracted to a ready or firing position.

Figure 3:
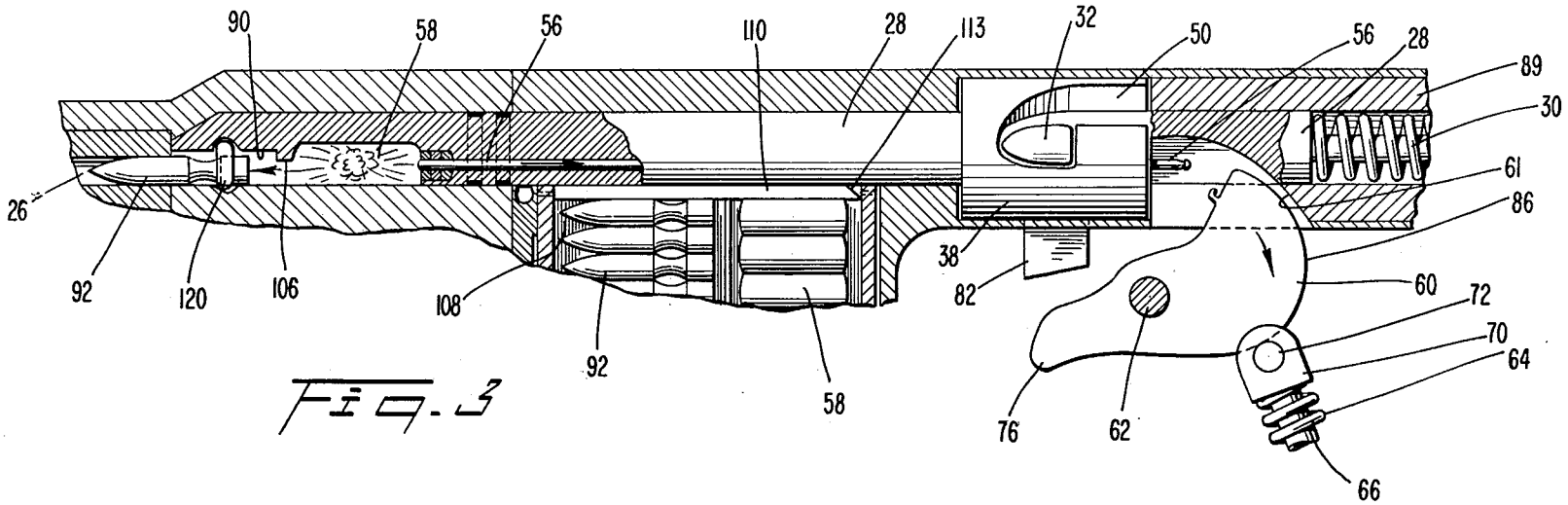
FIG. 3 is a view similar to FIG. 1 following detonation.
Figure 4:
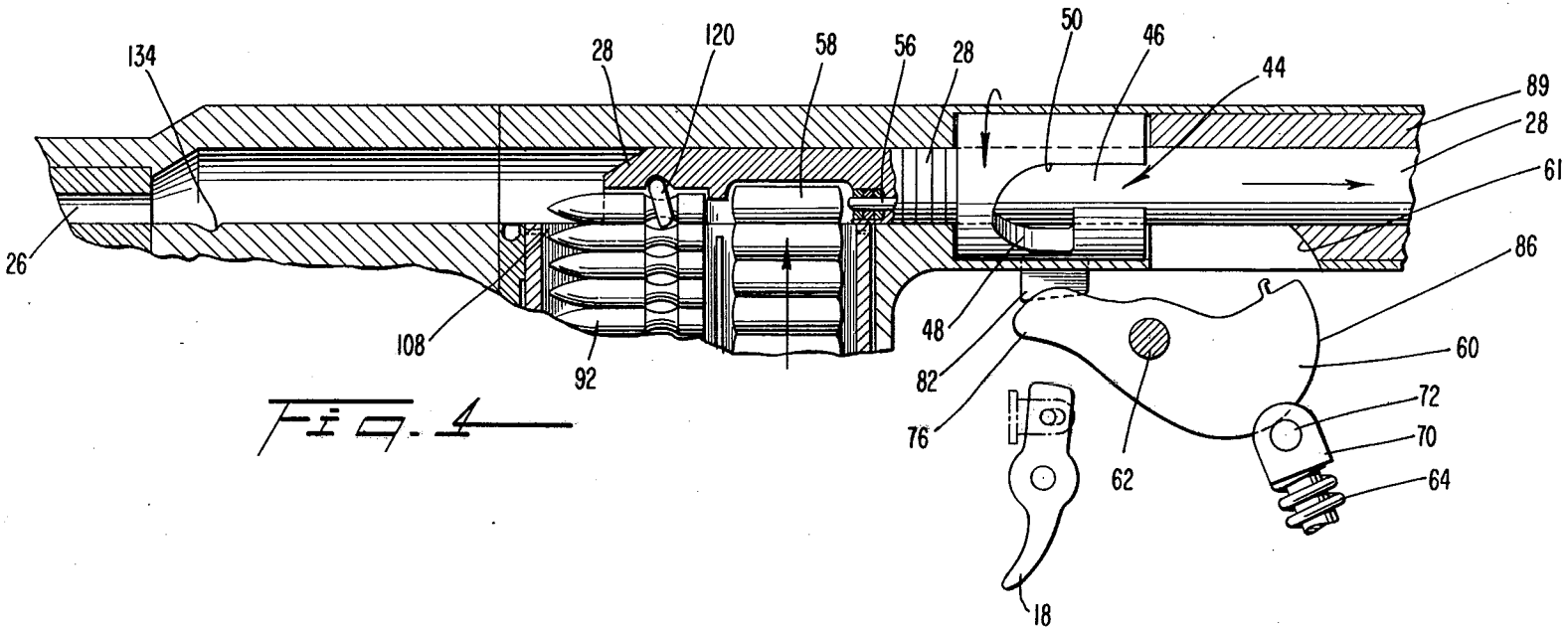
FIG. 4 is a view similar to FIG. 1 after the bolt has been unlocked and retracted by chamber gas pressure and a subsequent loading operation takes place.
Figure 6:
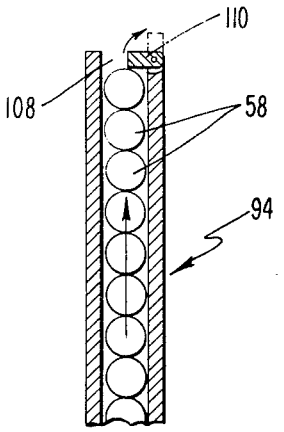
FIG. 6 is a cross-sectional view taken through the ammunition magazine along line 6—6 in FIG. 1.

The bolt upon release is urged forwardly by the bolt spring 30 so that the locking lugs 32, 34 enter the slot of the locking collar. The locking lugs contact the cam follower surface 50 of each slot and rotates the collar 38 to lock the bolt against retraction (FIG. 3).

At the same time, the projectile 92 and cartridge 58 are advanced and the projectile enters the bore of the barrel extension 232.

It will be realized that the projectile and cartridge are advanced by separate surfaces i.e., the front of the lip 106 and the surface 112 of the bolt, and, accordingly, the projectile enters the barrel without there occurring contact of the cartridge with the projectile or any other surface which could subject the cartridge to appreciable shock or compressive forces. Hence, there need be no requirement for the cartridge to be formed of highly rigid materials.

With the firearm disposed in a ready condition, the trigger 18 can be depressed, enabling the hammer spring 64 to rotate the hammer 60 and ram the firing pin 56 against the cartridge 58. The cartridge as a whole is compressed between the lip 106 and the firing pin, and the primer compound is compressed between the firing pin and the closed end of the first cartridge jacket 220. Consequently, the primer detonates and ignites the charge.

Ignition gas pressure communicates with the back end of the projectile to discharge the projectile through the barrel. Gas pressure also bears against the outer ring 148 of the seal assembly 145 of the bolt (FIG. 8) to deform the intermediate ring 150 against the outer periphery of the firing pin 56. Thus, a gas seal is created around the firing pin as the latter is displaced rearwardly by gas pressure.

The rearwardly traveling firing pin 56 thrusts against the hammer 60 and imparts sufficient momentum to the hammer to carry it past the rest position and to the override position (FIG. 4) against the bias of the hammer spring 64. Thereupon, the hammer extension 76 engages the collar turn lug 82 and rotates the locking collar 38 to align the longitudinal parts 46 of the slots 44, 44' with the locking lugs 32, 34. This enables the bolt 28 to be retracted by residual chamber gas pressure so that a new projectile and cartridge can be inserted into the pockets from the magazine.

Thereafter, the hammer is urged away from the turn lug 82 by the hammer spring 64 until stopped by the trigger (if the trigger has been released). If the trigger remains depressed, then the hammer continues rotating toward the firing pin and the firing sequence is repeated.

When the projectile is discharged from the barrel, ignition gas pressure bears against the reaction surface 168 of the anti-recoil muzzle 158 (FIG. 5) to advance the muzzle against the bias of the spring 166, to create anti-recoil forces. When the spring returns the muzzle, the reaction surface is scrubbed by the bristles 172 to remove carbon and other deposits.

In the event that a misfire occurs, or it is decided not to fire a shot, the firearm can be disarmed or cleared by manually retracting the bolt 28 via the bolt handle 36 (FIG. 7). In so doing, the extractor 120 (FIG. 9) swivels and the extractor lip 132 enters the groove 122 in the projectile 92. The extractor thus pushes the projectile rearwardly. With the magazine removed, the projectile and cartridge will simply fall through the opening formerly occupied by the magazine.

As this occurs, the bolt 28 engages and retracts the hammer 60. Since the latter is connected to the firing pin via engagement of the hook 140 within the recess 142, the firing pin is retracted. This is necessary since no ignition gas pressure is available to retract the hammer or the firing pin. Eventually, the hook 140 releases the firing pin 56 in a firing position.

SUMMARY OF MAJOR ADVANTAGES AND SCOPE OF THE INVENTION

The present invention provides for the loading of separate projectile and cartridge elements without subjecting the cartridge to appreciable stresses, and provides for convenient extraction of an unspent round. It will be appreciated, that the bolt itself functions in the manner of a conventional metallic casing of cased ammunition in that it carries the projectile and propellant, isolates the propellant from excessive stresses and shocks and enables the round to be extracted if not fired. Thus, the present invention marries the advantageous features of caseless ammunition with the reliable operation of traditional cased ammunition.

The present invention provides a simplified firing system in which a non-rotating bolt locks itself within a collar. This simplified locking arrangements greatly simplifies cleaning and servicing and also renders highly feasible the employment of replacement bolts. The practicality of having a substitute bolt depends to a large extent on the complexities of the locking system. That is, with a relatively simple locking system, it is much easier to fit locking lugs and locking recesses to acceptable tolerances in the manufacture of the gun than it is where multiple, relatively inaccessible surfaces must be machined to close tolerances.

The conventional turning bolt, for instance, has buried locking recesses which complicate the coaptation fitting of locking lugs and locking recesses in the manufacture of the gun, and also complicate the cleaning of the gun.

The proposed locking collar, which makes locking lugs and locking recesses visible, will facilitate the manufacture of an interchangeable bolt for that firearm. Moreover, since the locking collar is removable once the bolt is withdrawn, the locking collar and all bearing surfaces in the collar and fixed receiver will be readily available for field servicing and cleaning.

In the proposed firearm, then, a clean cool bolt, in effect a fresh chamber, can rapidly be substituted for the original bolt after a sustained period of firing without more than momentary interruption of firing.

In addition, after bolt withdrawal, a fresh cool barrel with its barrel extension which functions as the outer chamber walls can be installed without undue interruption of fire in the machine gun.

This will mean that all heated components of the gun are quick replaceable with fresh elements -- an important objective particularly in the infantry machine gun where periods of firing may be indeterminate, and overheating might otherwise render the gun inoperable.

Moreover, the firing pin performs a dual function in that it detonates a propellant cartridge and unlocks the bolt subsequent to firing a shot. Advantageously, such dual function of the firing pin is accomplished in a firearm wherein the firing sequence is initiated with the bolt situated in a forward, closed position. In addition, there are no springs acting directly against the firing pin and which are energized proportionally to firing pin displacement for the entire stroke of firing pin retraction. Rather, the hammer spring acts upon the hammer and is energized in proportion to clocking movement of the hammer for only a portion of the hammer stroke. The hammer spring is maintained at a substantially constant compression during the remainder of the stroke. As a result, the velocity and stresses to which the spring will be subjected will be minimized.

The anti-recoil muzzle incorporates an effective carbon cleaner and minimizes recoil action.

A new cartridge is provided which is of a shape that facilitates feeding, is inexpensive to manufacture, and leaves minimal residue.

An effective seal assembly for obturating around the firing pin is provided which eliminates the need for forming grooves in the firing pin to receive sealing rings and the accompanying weakening of the pin.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A firearm for firing caseless ammunition which comprises a projectile and a separate propellant cartridge, said firearm comprising:

a receiver, magazine means for feeding said projectile and said cartridge into said receiver, a bolt slidably mounted in said receiver, said bolt including laterally open pocket means for receiving said projectile and said cartridge from said magazine means and for advancing them to an armed position wherein said projectile is disposed within a bore of said barrel, and means carried by said bolt for extracting said projectile from the bore of said barrel in the event that said projectile is not fired.

2. A firearm according to claim 1 wherein said pocket means comprises a pair of pockets, one pocket receiving said projectile and the other pocket receiving said cartridge; said one pocket including a first surface means for engaging a rear end of said projectile, and said other pocket including a second surface means engaging a rear end of said cartridge.

3. A firearm according to claim 2 wherein said pockets are aligned and longitudinally spaced, said first surface means comprising a surface on a divider wall extending partially between said pockets.

4. A firearm according to claim 2 wherein said pockets are disposed in laterally spaced relationship.

5. A firearm according to claim 1 wherein said extracting means is mounted for movement automatically between a non-extracting position during advancement of said bolt, and an extracting position during retraction of said bolt.

6. A firearm according to claim 5 wherein said projectile includes as recess in the periphery thereof; said extracting means comprises a member including an extracting edge and leg means extending downwardly from said extracting edge into engagement with a wall of said receiver; said leg means, during advancement of said bolt, engaging said receiver surface and rotating said extracting edge away from engagement with said recess and, during retraction of said bolt, engaging said receiver wall and rotating said extracting edge into engagement with said recess in the event that said projectile has not been fired.

7. A firearm according to claim 6 wherein said extracting means is U-shaped, with said extracting ledge comprising part of a bight portion thereof and being rotatably mounted in a recess of said bolt, and said leg means comprising a pair of legs extending downwardly from said bight portion.

8. A firearm according to claim 1 including means driven by said bolt during advancement of the latter for locking said bolt against rearward movement.

9. A firearm according to claim 8 including a firing pin for detonating said cartridge, and means driven by said firing pin as the latter recoils in response to detonation, for unlocking said locking means.

10. A firearm according to claim 8 wherein said bolt is mounted for reciprocable, non-rotary movement and includes a laterally projecting locking lugs; said locking means comprising a locking collar mounted for rotary, non-reciprocating movement in said receiver; said locking collar including a slot having a longitudinal portion and an offset locking portion, said slot including wall means engageable by said locking lugs during advancement of the latter for producing rotation of said locking collar to bring said locking recess into encompassing relation around said locking lugs.

11. A firearm according to claim 10 including means for rotating said collar in response to firing said projectile, to free said locking lug from said locking recess and permit said bolt to travel rearwardly under the urging of residual chamber gas pressure.

12. A firearm according to claim 11 wherein said last-named means includes a firing pin reciprocably mounted in said bolt for detonating said cartridge; a hammer mounted for rotary movement; spring means for urging said hammer toward said firing pin, a trigger for retaining said hammer in a cocked position and for releasing said hammer for movement toward said firing pin; said firing pin being arranged so as to be responsive to ignition gas pressure for being rammed rearwardly against said hammer for pivoting said hammer into engagement with said locking collar to rotate the latter to unlock said bolt.

13. A firearm according to claim 1, including a firing pin reciprocably mounted in said bolt for detonating said cartridge; a hammer mounted for rotary movement, spring means for uging said hammer toward said firing pin; a trigger for retaining said hammer in a cocked position spaced from said firing pin and for releasing said hammer for movement toward said firing pin; said firing pin being arranged so as to be responsive to ignition gas pressure for being rammed rearwardly against said hammer for pivoting and recocking said hammer.

14. A firearm according to claim 13 wherein said hammer comprises a curved surface against which said spring means acts; said spring means acting in a linear direction against said hammer, with said curved surface being slidable relative to said spring means.

15. A firearm according to claim 13 wherein said hammer carries a retraction member which is engageable with said firing pin to retract said firing pin in the event that no detonation occurs to return said firing pin.

16. A firearm according to claim 1 including a firing pin reciprocably mounted in said bolt for detonating said cartridge; said bolt carrying means for creating a gas seal around the periphery of said firing pin, said seal means comprising inner and outer rigid rings and an intermediate ring disposed circumferentially around said firing pin, said intermediate ring comprising a deformable material; said outer ring being exposed to detonation gas pressure to compress said intermediate ring against said inner ring to deform said intermediate ring into sealing engagement with said firing pin.

17. A firearm according to claim 1 including an anti-recoil muzzle mounted at a discharge end of said barrel; said muzzle being mounted for longitudinal displacement relative to said barrel and including reaction surface means against which ignition gas pressure acts to displace said anti-recoil muzzle means forwardly to counteract recoil forces; said barrel including a plurality of stiff bristles projecting forwardly toward said reaction surface means to scrub unwanted deposits therefrom.

18. A firearm according to claim 1 in combination with a propellant cartridge comprising first and second cylindrical jackets having one open end and one closed end, the open end of said first jacket being telescopingly received in the open end of said second jacket to define a chamber occupied by a charge of combustible propellant; and a third cylindrical jacket having an open end and a closed end, the open end of said third jacket telescopingly receiving the closed end of said first jacket; the closed ends of said first and third jackets being spaced to define a compartment occupied by priming compound.

* * * * *